United States Patent [19]

Moller

[11] Patent Number: 4,509,712

[45] Date of Patent: Apr. 9, 1985

[54] EASEL FORMED BY TWO CROSSED TABS AT BACK OF DISPLAY OBJECT

[76] Inventor: Carl Moller, 101 W. 57th St., New York, N.Y. 10019

[21] Appl. No.: 460,479

[22] Filed: Jan. 24, 1983

[51] Int. Cl.[3] ..... A47B 97/04

[52] U.S. Cl. ..... 248/464; 248/472

[58] Field of Search ..... 248/460, 464, 447, 455, 248/456, 457, 459, 463, 464, 465, 472, 469; 40/152.1

[56] References Cited

U.S. PATENT DOCUMENTS

| | | | |
|---|---|---|---|
| 1,053,112 | 2/1913 | Scott | 248/456 |
| 1,232,766 | 7/1917 | Cadmus | 248/463 |
| 1,303,306 | 5/1919 | Heithaus | 248/459 |
| 2,450,495 | 10/1948 | Ullmann | 40/152.1 |
| 3,355,828 | 12/1967 | Betz | 40/152.1 |
| 3,411,741 | 11/1968 | Nadler | 248/463 X |
| 3,545,115 | 12/1970 | Nichols | 40/152.1 |
| 3,707,791 | 1/1973 | Levy | 248/463 |
| 4,229,892 | 10/1980 | Hueter | 40/152.1 |

*Primary Examiner*—J. Franklin Foss

*Attorney, Agent, or Firm*—Paul W. Garbo

[57] ABSTRACT

An easel for display objects such as pictures and placards is formed by two flexible tabs hinged at the back of the display object and adapted to be locked in crossed relation in order to support the display object in an upward position.

Cardboard and plastics are preferred flexible materials for making the novel easel. A flexible sheet can be die-cut to produce the two tabs that remain hinged to the sheet. The easel, with or without a picture frame, can also be produced by injection molding of a plastic.

The easel tabs can be locked in adjustably crossed relation to vary the tilt of the upwardly held display object.

20 Claims, 9 Drawing Figures

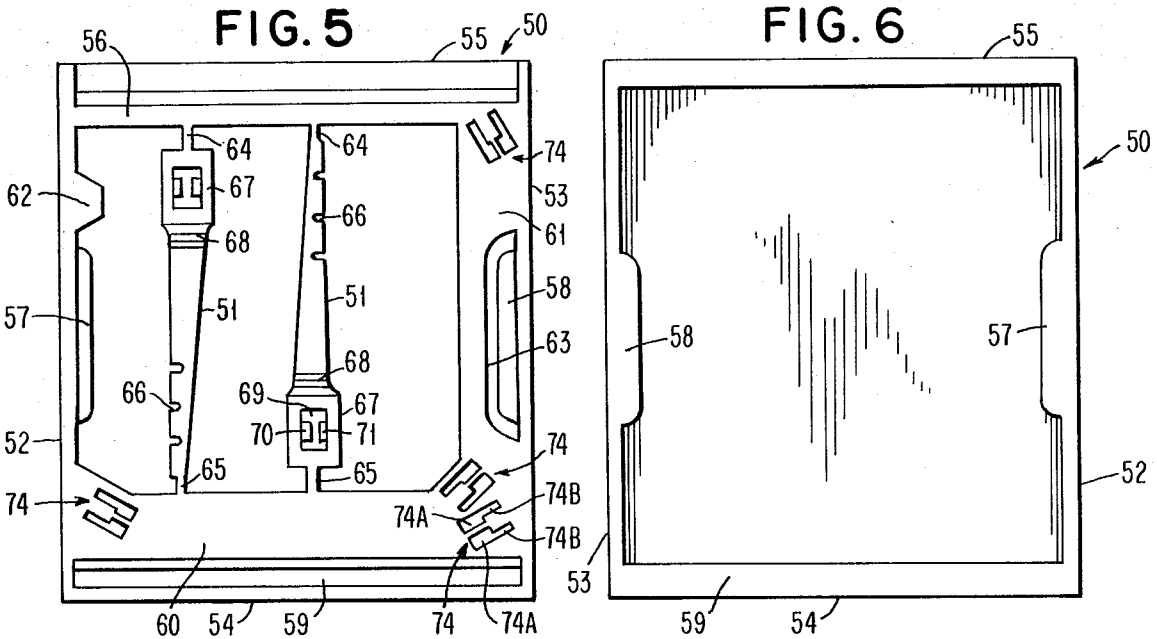
FIG. 5
FIG. 6
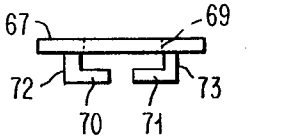
FIG. 7
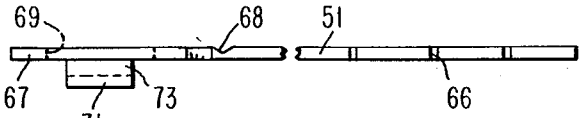
FIG. 8
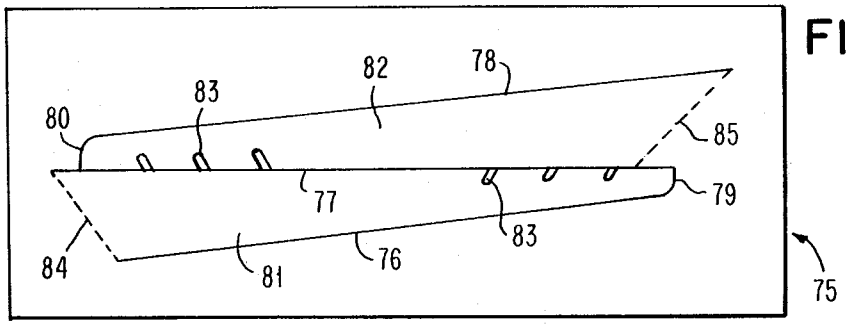
FIG. 9

EASEL FORMED BY TWO CROSSED TABS AT BACK OF DISPLAY OBJECT

BACKGROUND OF THE INVENTION

This invention relates to means for holding placards, pictures and like display objects in an upward position when placed on a table or shelf. More particularly, this invention involves an easel formed by two flexible tabs hinged at the back of the display object and adapted to be locked in crossed relation in order to support the display object in an upward position.

Numerous forms of easels have been proposed but relatively few have been found commercially feasible. For example, U.S. Pat. No. 3,707,791 to Levy shows a backing member for a picture frame which includes a triangular supporting member, a triangular bracing member and a tab, all integrally hinged together. The two triangular members and tab can be folded into a supporting tetrahedron. An embossment which receives the tab locks the tetrahedron in supporting position. FIG. 6 of the Levy patent makes it obvious that the two triangular members and the attached tab add considerably to the area of the backing. Consequently, the cost of the backing is increased by the greater amount of plastic consumed and by the larger mold required to produce this easel back.

U.S. Pat. No. 3,355,828 to Betz discloses a mount for photographs in which the backing is slit to provide one large diagonal tab hinged at the center of the backing and to provide a contiguous, small triangular tab hinged at about the midpoint in the length of the large tab. The triangular tab is used to lock the large diagonal tab in position to support the photograph upright. Betz's backing avoids the excess material required by Levy's backing. However, the easel formed by Betz takes up a large portion of the area of the backing and thus is a prominent part of the photograph mount detracting from its appearance. Moreover, in cases where the backing is desired to carry printed information, the two tabs not only greatly reduce the area available for the printed matter but also are clearly obtrusive in appearance.

The term, easel, as used in this specification and the appended claims, is broadly defined as means for holding a display object such as a show card, placard, photograph or picture, with or without a frame, in an upward position when such display object is placed on a support surface such as a table, counter or shelf.

A principal object of this invention is to provide an easel occupying only a narrow area of the back of the display object along its bottom edge.

Another important object is to provide an easel that is easily adjusted to hold the display object in different tilted upward positions.

Still another object is to provide an easel that avoids the use of excess material and is produced at low cost.

A further object is to provide an easel that is simultaneously produced with a frame for the display object by the injection molding of a plastic.

Other features and advantages of the invention will be apparent from the description which follows.

SUMMARY OF THE INVENTION

In accordance with this invention, an easel for a display object comprises a lower elongate flexible tab disposed near and along the bottom edge of the display object and hinged at the back near one lower corner of the display object and an upper elongate flexible tab disposed near and along the top edge of the lower tab and hinged at the back near the other lower corner of the display object, both tabs being adapted to be bent into a crossed relation so as to hold the display object upright. At least one notch in the top edge of the lower tab and one in the bottom edge of the upper tab are preferred means for locking the crossed tabs together. This easel can be an integral part of or an addition to a picture frame or a backing for a frame or a unit to hold an unframed show card.

The easel is made of a flexible material. Plastics and cardboard are in most cases preferred because of their low cost. Thin sheet metal may be used in some cases where the cost is justified. The hinge lines of the two tabs are preferably slanted so that the distance between the bottom ends of the two hinge lines is shorter than the distance between their top ends. Depending on the flexibility of the material selected for making the easel, it is advisable to indent, score or corrugate the hinge lines of the tabs so that the tabs can be swung outwardly from the back of the display object more easily and thus minimize bending the tabs at places other than the intended hinge lines. In some cases, two or more indented, scored or corrugated lines may be used to increase flexibility at the hinges of the tabs.

A feature of the easel is that the display object can be held in an adjustably tilted upward position. By providing several spaced notches in both tabs, the tabs can be locked in adjustably crossed relation to vary the tilt of the upward position of the display object.

For a better understanding of the invention, the further description thereof will refer to the accompanying drawings.

BRIEF DESCRIPTION OF THE DRAWINGS

FIG. 5 is a rear view of another injection-molded plastic picture frame which incorporates the novel easel in a form that permits its placement either along the short edge of the frame or along the long edge thereof;

FIG. 6 is a front view of the frame of FIG. 5 into which a backing sheet for the picture has been inserted;

FIG. 7 is an enlarged end view of one of the movable tabs of the easel of the frame of FIG. 5;

FIG. 8 is a right side view of the tab shown in FIG. 7; and

FIG. 9 is a rear view of another easel of the invention made of a flexible sheet which can be attached to the back of a display object along its bottom edge.

DESCRIPTION OF PREFERRED EMBODIMENTS

Figure 1:
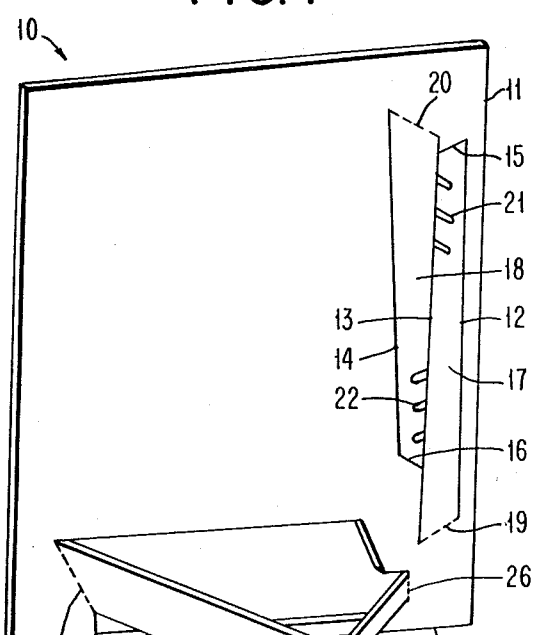
FIG. 1 is a standing rear view of a backing for a picture frame embodying two easels of this invention.

FIG. 1 shows a cardboard backing 10 for a picture frame which has been die-cut to provide two embodiments of the easel of this invention. One easel is disposed near and along a long edge 11 of backing 10 so that the frame used with backing 10 can be set up on its long edge corresponding to edge 11 of backing 10. Three long cut lines 12,13,14 and two short cut lines 15,16 create lower tab 17 and upper tab 18. Hinge lines 19,20 of tabs 17,18, respectively, are preferably indented or scored to facilitate bending at hinges 19,20 when tabs 17,18 are pulled out of the plane of backing 10. The die-cutting of backing 10 also provides several top notches 21 in lower tab 17 and several bottom notches 22 in upper tab 18. When tabs 17,18 are used to hold backing 10 and an associated frame in an upward position, the slant of the standing frame can be varied depending on which notch top 21 and which bottom notch 22 are nested together to hold tabs 17,18 in crossed relation.

The second easel disposed near and along a short edge 23 of backing 10 is formed by die-cutting as already explained for tabs 17,18. Lower tab 24 and upper tab 25 are shown bent out of backing 10 along hinge lines 26,27. Tabs 24,25 are locked in crossed relation by nesting a top notch 28 and a bottom notch 29.

Figure 3:
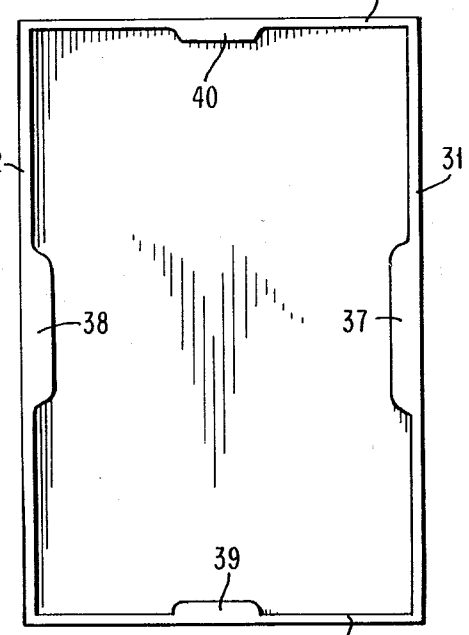
FIG. 3 is a front view of the frame of FIG. 2 into which a backing sheet for the picture has been inserted.
Figure 2:
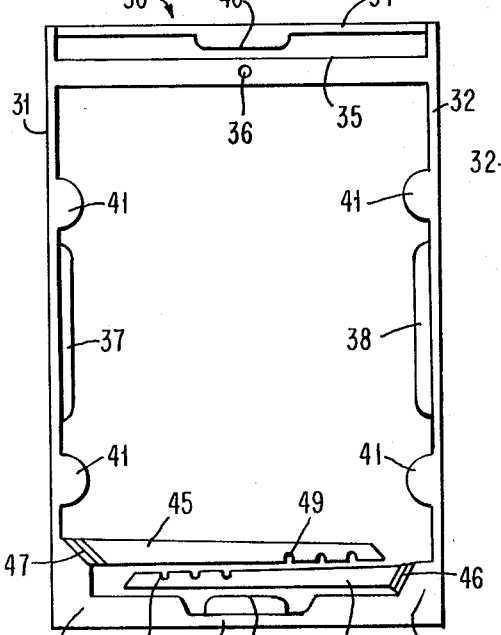
FIG. 2 is a rear view of an injection-molded plastic picture frame which incorporates the easel of this invention.
Figure 4:
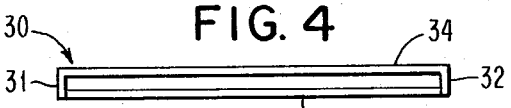
FIG. 4 is a top view of the frame of FIG. 2.

The injection-molded plastic picture frame 30 of FIGS. 2,3,4 includes the easel of this invention as an integral part thereof. Frame 30 has two lateral walls 31,32 joined to base 33, frame top 34 and back band 35. As seen in FIG. 4, lateral walls 31,32 have frame top 34 joined along their front edges and back band 35 joined along their rear edges. Lateral walls 31,32 are wide enough to allow a photograph or the like and usually also a pane of glass to slide into frame 30 when inserted in the top opening between frame top 34 and back band 35. Hole 36 in back band 35 can be used to hang frame 30 on a wall by letting the head of a nail driven into the wall enter hole 36.

As seen in FIG. 3, tabs 37,38 on the front edges of lateral walls 31,32, respectively, tab 39 on the front edge of base 33 and tab 40 on frame top 34 keep the picture and glass from falling out of the front of frame 30. As seen in FIG. 2, the back edges of lateral walls 31,32 have four tabs 41 and two bottom corner tabs 42,43 which together with back band 35 keep the picture and glass from falling out of the back of frame 30.

The easel of the invention has lower tab 44 integrally formed with and connected to corner tab 43, while upper tab 45 is similarly formed and connected to corner tab 42. The hinge areas 46,47 of tabs 44,45 are corrugated to increase flexibility. Lower tab 44 has several top notches 48 and upper tab 45 has several bottom notches 49. When tabs 44,45 are bent back away from frame 30, they can be locked in an adjustably crossed relation depending on which top notch 48 and which bottom notch 49 are fitted together. The adjustably crossed relation of tabs 44,45 of the easel serves to adjust the tilt of the upwardly held frame 30.

The injection-molded plastic picture frame 50 of FIGS. 5,6 is simultaneously formed with both easel tabs 51 in a single cavity of a mold. In many ways, frame 50 of FIGS. 5,6 is similar to frame 30 of FIGS. 2,3,4. Thus, frame 50 has lateral walls 52,53 joined to base 54, frame top 55 and back band 56. As seen in FIG. 6, tabs 57,58 are attached to the front edges of walls 52,53 to which frame top 55 is also attached. Frame bottom 59 is a tab formed on the front edge of base 54 and extends over the full length of base 54. Tabs 57,58, frame top 55 and frame bottom 59 act as retainers of a picture or the like along its four edges so that it cannot fall out of the front of frame 50.

The back edges of lateral walls 52,53 have base band 60 as well as back band 56 attached thereto. The back edge of wall 53 also has lateral band 61 as an integral part thereof. Lateral band 61 extends from back band 56 to base band 60, these three bands 56,60,61 forming an integral plate which acts as the back retainer for any picture and glass inserted into frame 50 through the top opening between frame top 55 and back band 56. Tab 62 formed on the back edge of lateral wall 52 provides additional back support for any display object placed in frame 50. Lateral band 61 is formed with a long opening 63 which makes lateral tab 58 completely visible in FIG. 5. Opening 63 is necessary for producing frame 50 in an injection mold.

The two easel tabs 51 are identical and are formed simultaneously with frame 50 in a mold cavity which forms thin connections 64 between back band 56 and an end of each of tabs 51 and thin connections 65 between base band 60 and the other end of each of tabs 51. FIG. 5 shows frame 50 as it is after being withdrawn from the injection mold and as it can be easily shipped or mailed in a compact flat container. The user of frame 50 detaches each tab 51 from frame 50 merely by forcing it until its thin connections 64,65 break. Of course, scissors or a knife can be used to cut connections 64,65. Each tab 51 has notches 66 spaced along one of its edges and is connected to an anchoring end 67 by grooved or scored hinge 68. End 67 has a rectangular aperture 69 through which grippers 70,71 can be seen in FIG. 5.

FIG. 7 is an enlarged end view of anchoring end 67 of tab 51. Grippers 70,71 are L-shaped members formed on the inner face of end 67. The L-shaped grippers 70,71 face each other and are attached by their uprights 72,73, respectively, to end 67 along opposite edges of aperture 69. As in the case of opening 63 in lateral band 61, aperture 69 in end 67 is required for forming grippers 70,71 by injection molding. FIG. 8 is a right side view of anchoring end 67 of FIG. 7 together with its easel tab 51.

Referring to FIG. 5, base band 60 has a pair of apertures 74 near its bottom edge and near lateral wall 53 and another pair of apertures 74 near its top edge and near lateral wall 52. Each aperture 74 has a wide portion 74A and a narrow portion 74B. The apertures 74 of each pair are positioned opposite and parallel to each other with less spacing between their wide portions 74A than between their narrow portions 74B. The dimensions and spacing of each pair of apertures 74 are such that grippers 70,71 of anchoring end 67 can be pressed into wide portions 74A and then uprights 72,73 can be slid into narrow portions 74B. Thus, grippers 70,71 are brought into contact with the back face of base band 60 and thereby clamp anchoring end 67 to band 60. Of course, grippers 70,71 contact the part of band 60 that is between the narrow portions 74B of the paired apertures 74. With end 67 of one tab 51 locked, as already explained, into the pair of apertures 74 near the bottom edge of band 60, the lower tab of the easel of the invention is in place. Similarly, end 67 of the other tab 51 is locked into the pair of apertures 74 near the top edge of band 60 to provide the upper tab of the easel. By bending both tabs 51 away from band 60 and inserting one notch 66 of one tab 51 into a notch 66 of the other tab 51, tabs are fastened in crossed relation to act as the easel for holding frame 50 in an upward position when placed with its base 54 on a table or other supporting surface.

Lateral band 61 has a pair of apertures 74 near wall 53 and band 56 for clamping an anchoring end 67 thereto and another pair of apertures 74 near the free edge of lateral band 61 where it meets band 60 for clamping the other anchoring end 67 thereto. Tab 51 of anchoring end 67 fastened to band 61 near wall 53 acts as the lower easel tab while tab 51 of anchoring end 67 fastened to band 61 near its free edge provides the upper easel tab of the invention. With tabs 51 positioned along lateral band 61 locked in crossed relation, frame 50 can be held in an upward position when placed with wall 53 on a supporting surfaces. Thus, movable tabs 51 make it possible to stand frame 50 on either base 54 or lateral wall 53.

FIG. 9 shows easel 75 as a unit which can be attached to the back of any display object. Easel 75 is made of a flexible sheet, preferably cardboard because of its low cost, which is die-cut to form two easel tabs. Three long slits 76,77,78 and two end cuts 79,80 form two tabs 81,82, each of which has several cut-out notches 83 along its edge produced by slit 77. Tab 81 is indented at hinge line 84 to facilitate bending thereat and tab 82 is similarly indented at its hinge 85. Easel 75 is fastened to the back of any display object such as a commercial show card with an adhesive or staples applied to the marginal areas of easel 75 so that tabs 81,82 remain free to be pulled out from the original plane of easel 75. Easel 75 is positioned on the back of the show card so that either of its long edges will be very close to, or actually contact, the counter top on which the show card is displayed. Inasmuch as easel 75 will cover only a narrow band of the show card's back along the bottom edge thereof, usually not more than about 15% of the total area of the back, the remaining upper and major part of the back is admirably suited for carrying sales information and suggestions for the store's clerks, while the card's front carries an advertisement to attract customers.

Many variations and modifications of the invention will be visualized by those skilled in the art without departing from the spirit and scope of the invention, already illustrated by several embodiments. For instance, easel 75 of FIG. 9 can be made by the injection-molding of polypropylene or other plastic. In such case, cut lines 76,77,78,79,80 will be replaced by narrow spaces or gaps in the molded unit. Easel 75 can also be an integral part of a cardboard show card which, after it has been printed, is folded back near its base so that the portion embodying easel 75 is brought into contact with, and is adhesively fastened to, the back of the show card. Referring to FIGS. 2 and 3, an injection-molded plastic easel for a display object which does not require a frame can be made in a mold that forms a unit with only elements 33,39,42,43,44,45,46,47,48,49.

While notches in the tabs are very simple means for locking the tabs in crossed relation, many alternatives are available. For example, the common wire tie ribbon for plastic bags can be twisted around the tabs where they cross or a U-shaped plastic or metal clip, even an ordinary wire paper clip, can be slipped over the tabs at their crossing point. Sawtooth or serrated edges on the tabs will obviously provide a multiplicity of notches for locking the tabs in adjustably crossed relation.

Obviously, the means shown in FIGS. 5,7 and 8 for attaching tabs 51 to the back of frame 50 can be replaced by other known means. For example, each anchoring end 67 can be reduced in size and made in the form of a plain short tab which slips into a slot that replaces every pair of apertures 74. The short tab will thus be sandwiched between base band 60 or lateral band 61 and the display object. Of course, the mold for frame 50 can be simplified to produce frame 50 without the two tabs 51. In fact, in some cases, it may be more economical to produce tabs 51 separately in a mold having a multiplicity of identical cavities. Moreover, tabs 51 with anchoring ends 67 preferably as plain short tabs can be sold in pairs for attachment by glueing or tacking to the back of any frame or show card. Accordingly, only such limitations should be imposed on the scope of the invention as are set forth in the appended claims.

What is claimed is:

1. An easel for holding a display object in an upward position when placed on a support surface, which comprises a first elongate flexible tab disposed near and along the bottom edge of said display object and hinged at the back of said display object near one lateral edge of said display object, a second elongate flexible tab disposed above and along said first tab and hinged at the back of said display object near the opposite lateral edge of said display object, the hinge lines of said first tab and said second tab being slanted so that the distances between the bottom ends of said hinge lines and between the top ends of said hinge lines are unequal, at least one first notch in the top edge of said first tab, and at least one second notch in the bottom edge of said second tab, said first notch and said second notch being adapted to lock said first tab and said second tab in crossed relation in order to hold said display object in an upward position.

2. The easel of claim 1 wherein the first tab and the second tab are formed by slits in a flexible sheet.

3. The easel of claim 2 wherein the flexible sheet is cardboard which is scored at the hinge lines of the first tab and the second tab.

4. The easel of claim 1 wherein the first tab and the second tab are attached to the back of a frame for the display object, said frame together with said first tab and said second tab being an injection-molded plastic product.

5. The easel of claim 1 wherein there are several spaced first notches in the top edge of the first tab and several spaced second notches in the bottom edge of the second tab, said first notches and said second notches being adapted to lock said first tab and said second tab in adjustably crossed relation in order to hold the display object in an adjustably upward position.

6. The easel of claim 5 wherein the first tab and the second tab are formed by slits in a flexible sheet.

7. The easel of claim 6 wherein the flexible sheet is cardboard which is scored at the hinge lines of the first tab and the second tab.

8. The easel of claim 5 wherein the first tab and the second tab are attached to the back of frame for the display object, said frame together with said first tab and said second tab being an injection-molded plastic product.

9. An injection-molded plastic easel for holding a display object in an upward position when placed on s aupport surface, which comprises a lower elongate tab flexibly hinged to a fixed end near a lower corner of said display object and extending along the bottom of said display object, an upper elongate tab flexibly hinged to a fixed end near the other lower corner of said display object and extending along the top edge of said lower tab, the hinge lines of said lower tab and said upper tab being slanted so that the distance between the bottom ends of said hinge lines is shorter than the distance between the top ends of said hinge lines, said lower and upper tabs being adapted to be bent into a crossed relation in order to hold said display object in an upward position, and means for locking said crossed tabs together.

10. The easel of claim 9 wherein the lower tab and the upper tab have indentations along their hinge lines.

11. The easel of claim 10 wherein the fixed ends of the lower tap and the upper tab are attached to the back of a frame for the display object.

12. The easel of claim 11 wherein the frame is formed with the lower tab and the upper tab by the injection molding of a plastic.

13. The easel of claim 10 wherein the means for locking the crossed tabs together are several spaced notches in each of the contiguous edges of said tabs so that said tabs can be locked in adjustably crossed relation in order to hold the display object in an adjustably upward position.

14. The easel of claim 10 wherein the fixed ends of the lower tab and the upper tab are unitary parts of an elongate clamp base into which the bottom edge of the display object fits.

15. The easel of claim 9 wherein the fixed ends of the lower tab and the upper tab have means for attaching said fixed ends to the back of a frame for the display object.

16. The easel of claim 15 wherein the lower tab and the upper tab are corrugated along their hinge lines and the frame is formed with said lower tab and said upper tab by the injection molding of a plastic.

17. The easel of claim 16 wherein the back of the frame has receptors for the means for attaching the fixed ends of the lower and upper tabs along both the bottom and one lateral edge of said frame.

18. A combined flexible back sheet and easel for a picture frame having a lower elongate tab and an upper elongate tab disposed near and along a first edge of said sheet, said lower tab and said upper tab being slit portions of said sheet hinged near a second edge and an opposite edge, respectively, of said sheet, the hinge lines of said lower tab and said upper tab being slanted so that the distance between the bottom ends of said hinge lines is shorter than the distance between the top ends of said hinge lines, said lower and upper tabs being adapted to be bent into a crossed relation, and means for locking said crossed tabs together.

19. The combined flexible back sheet and easel for a picture frame of claim 18 wherein said sheet is cardboard which is scored along the hinge lines of the lower tab and the upper tab.

20. The combined flexible back sheet and easel for a picture frame of claim 19 wherein there are several spaced notches in each of the contiguous edges of said tabs as the means for locking said tabs in adjustably crossed relation.

* * * * *